US010138604B2

(12) United States Patent
Lee et al.

(10) Patent No.: US 10,138,604 B2
(45) Date of Patent: Nov. 27, 2018

(54) RAIL TIE HAVING EMBEDDED AUTOMATIC DIFFERENTIAL SETTLEMENT COMPENSATION APPARATUS USING OIL PRESSURE FOR RAILROAD TRACKS

(71) Applicant: KOREA RAILROAD RESEARCH INSTITUTE, Gyeonggi-do (KR)

(72) Inventors: Seong-Hyeok Lee, Gyeonggi-do (KR); Jin-Wook Lee, Seoul (KR)

(73) Assignee: KOREA RAILROAD RESEARCH INSTITUTE, Gyeonggi-do (KR)

( * ) Notice: Subject to any disclaimer, the term of this patent is extended or adjusted under 35 U.S.C. 154(b) by 214 days.

(21) Appl. No.: 15/120,524

(22) PCT Filed: Dec. 4, 2014

(86) PCT No.: PCT/KR2014/011794
§ 371 (c)(1),
(2) Date: Aug. 22, 2016

(87) PCT Pub. No.: WO2015/129996
PCT Pub. Date: Sep. 3, 2015

(65) Prior Publication Data

US 2017/0009405 A1 Jan. 12, 2017

(30) Foreign Application Priority Data

Feb. 25, 2014 (KR) ..... 10-2014-0022039

(51) Int. Cl.
*E01B 29/04* (2006.01)
*E01B 3/30* (2006.01)
*E01B 1/00* (2006.01)

(52) U.S. Cl.
CPC ..... *E01B 29/04* (2013.01); *E01B 3/30* (2013.01); *E01B 1/001* (2013.01); *E01B 2202/027* (2013.01)

(58) Field of Classification Search
CPC ..... E01B 1/00; E01B 3/00; E01B 3/28; E01B 29/00; E01B 29/02; E01B 29/04; E01B 37/00
See application file for complete search history.

(56) References Cited

U.S. PATENT DOCUMENTS

2014/0183271 A1 7/2014 Hughes

FOREIGN PATENT DOCUMENTS

JP H0874202 3/1996
JP 2006274720 10/2006
(Continued)

OTHER PUBLICATIONS

Coenraad Esveld, "Innovations in Railway Track," TU Delft, Jan. 1997, pp. 1-12.
(Continued)

*Primary Examiner* — Robert J McCarry, Jr.
(74) *Attorney, Agent, or Firm* — JCIPRNET

(57) ABSTRACT

By supporting a space generated by a settlement of the track bed gravel or asphalt roadbed underneath a concrete rail tie with cylindrical rods, and installing the present invention, one each separately, on the left and right sides of the concrete rail tie, recovery from settlements is automatic, and the response to differential settlements of the left and right rails of the track due to the train load can be easily facilitated, and by installing pressure reducing valves on the upper part of the concrete rail ties, pressure can be reduced while maintaining the track system as is without having to dismantle the concrete rail ties, and accordingly the usability of the concrete rail ties can be improved.

9 Claims, 11 Drawing Sheets

(56) References Cited

FOREIGN PATENT DOCUMENTS

| | | | | |
|---|---|---|---|---|
| JP | 2011047143 | | 3/2011 | |
| JP | 2011047143 | * | 10/2011 | ..... E01B 3/00 |
| KR | 101331013 | | 11/2013 | |
| KR | 20130137465 | | 12/2013 | |
| KR | 101353466 | | 1/2014 | |

OTHER PUBLICATIONS

"International Search Report (Form PCT/ISA/210)", dated Feb. 27, 2015, with English translation thereof, pp. 1-4.

* cited by examiner

RAIL TIE HAVING EMBEDDED AUTOMATIC DIFFERENTIAL SETTLEMENT COMPENSATION APPARATUS USING OIL PRESSURE FOR RAILROAD TRACKS

CROSS-REFERENCE TO RELATED APPLICATION

This application is a 371 of international application of PCT application serial no. PCT/KR2014/011794, filed on Dec. 04, 2014, which claims the priority benefits of Korea application no. 10-2014-0022039, filed on Feb. 25, 2014. The entirety of each of the above—mentioned patent applications is hereby incorporated by reference herein and made a part of this specification.

TECHNICAL FIELD

The present disclosure relates to a sleeper having an embedded automatic track differential settlement compensation apparatus, and more particularly, to a sleeper having an embedded automatic track differential settlement compensation apparatus which is installed at a concrete sleeper provided on track bed gravel or an asphalt roadbed, and capable of automatically compensating for a track differential settlement due to a traveling load of a train using oil pressure, and a compensation method for the same.

BACKGROUND ART

Generally, a track on which a train or the like travels and in which a track bed is provided on a roadbed and then a sleeper and a rail are provided on the track bed is widely known. Here, the track bed is a track material that serves to highly disperse a train load transmitted from the rail and the sleeper to deliver it to a roadbed and to fix the sleeper at a predetermined position, and gravel (or crushed stone) or concrete is used for the track bed. Conventionally, a track bed gravel (or a gravel track bed) track is referred to as a ballast track.

A structure of such a track is generally provided so that sleepers are arranged on a track bed formed on a roadbed and then a pair of rails is provided in parallel at regular intervals to be attached to the sleepers. A track bed configuring such a track includes ballast, a slab or the like, that is selected in consideration of various conditions of a train route. Specifically, a ballast track, which uses ballast including gravel, crushed stone, and the like, is widely known. Because the track bed using such ballast is superior from an economical aspect while reasonably supporting a running of a heavy train due to a characteristic of the track bed, it has been employed for a very long time. Such ballast including gravel, crushed stone, and the like has functions for securely maintaining sleepers, uniformly distributing a load that is delivered from a train via the rail and the sleepers to the roadbed, allowing the track to have elasticity, facilitating damping work and the like, enhancing drainage of the track to prevent generation of mud or weeds, and so on.

FIG. 1 is a cross-sectional view of a bed gravel track, and FIG. 2 is a view for describing a damaged form of track bed gravel of the bed gravel track.

As shown in FIG. 1, a bed gravel track 10 is formed on a reinforced roadbed 11, and a weight loaded from wheels of a train is delivered to track bed gravel 12 through a rail 14 and a sleeper 13, and thus the weight is dispersed at such track bed gravel 12 through a contact point of each particle of a track bed.

At this point, a function of the track bed gravel 12 is to uniformly distribute pressure of a lower surface of the sleeper 13 to the reinforced roadbed 11, and the track bed gravel 12 secures a track bed resistance force in a longitudinal direction of the sleeper 13 and elastically supports such a sleeper 13 to buffer an impact force, thereby reducing damage to the track. Also, such track bed gravel 12 is able to fix the sleeper 13 at a predetermined position, correct a track irregularity, and allow renewal work of a sleeper to be facilitated.

In particular, crushed gravel is mainly used as a material of the track bed gravel forming the track bed gravel 12, and the crushed gravel is provided by, for example, crushing slickensides with a crusher to have a grain size distribution in which grain sizes in a range of 10 to 65 mm are properly mixed. At this point, a thickness of the track bed gravel may be determined by a shape dimension of the sleeper 13, a distance between sleepers 13, an ability of a track bed material to disperse a load, a magnitude of a train load, and a supporting force of a roadbed.

Also, such track bed gravel is damaged by a dynamic load of the train, and, for example, consolidation, a lateral flow, a roadbed penetration, granulation, and the like may occur as such damage of the track bed gravel shown in FIG. 2. Among the damage, consolidation and a lateral flow occur by vibration generated due to a running of a train and are the cause of a track irregularity of the track bed gravel such that there is a problem in that maintenance is frequently required due to such damage.

In addition, a variety of causes may result in such damage to the bed gravel track, and prominent causes among the variety of causes may be vibration generation due to a dynamic load, a settlement and a lateral flow of the track bed gravel due to such vibration generation, and a weakness effect of the roadbed due to rainwater.

Such track bed gravel should be preserved and managed so as to consistently maintain a cross-sectional shape at a time when it was constructed, and thus there is a problem in that permanent management is required to maintain a cross section of the track bed and secure a resistance force by consistently performing track bed trimming, gravel supplementing, and the like since track bed relaxation and gravel scattering due to vibration when a train runs, a collapse of a cross-sectional area of a track bed shoulder due to a maintenance person entering the track, a loss by gravel flowing into a collecting well, a drainage canal, or the like of a trackside, and so on.

Meanwhile, FIGS. 3*a* and 3*b* are diagrams respectively illustrating a mechanism in which a loose sleeper occurs at a track.

As shown in FIG. 3*a*, a ballast track has a structure in which ballast 12 is formed on the reinforced roadbed 11 and the concrete sleeper 13 is disposed between the ballast 12 and the rail 14, and the concrete sleeper 13 and the rail 14 are fastened to each other by a rail fastener 15.

At this point, when a train 21 repeatedly passes, the concrete sleeper 13 is upwardly and downwardly moved due to a normal load of the train 21 as shown in FIG. 3*b*, and the ballast 12 such as gravel and the like is settled when a time has elapsed such that a space underneath the concrete sleeper 13 is expanded as indicated by a reference numeral A.

As a result, a floating phenomenon of a sleeper, in which a space is formed underneath the concrete sleeper 13, occurs when the time has elapsed. The sleeper that has undergone such a floating phenomenon is referred to as a loose sleeper, and the concrete sleeper 13 is upwardly and downwardly moved whenever the train 21 passes over the loose sleeper, which degrades ride quality as the concrete sleeper 13 is gradually and severely moved, and thus great impact is delivered to the concrete sleeper 13 and the like when the train 21 is passing and problems, in which an amount of maintenance and a cost thereof are increased, are caused.

In other words, when no load exists at a ballast track, the concrete sleeper 13 which is in a state of not being in contact with the ballast 12, for example, gravel or crushed stone, and hanging on the rail 14 is referred to as a loose sleeper. When such a loose sleeper occurs, the ballast 12 and the loose sleeper collide with each other when the train travels such that a track condition is rapidly degraded by a crushing of the ballast 12 and generation of mud. Furthermore, in a section at which a plurality of loose sleepers occur, upward and downward displacements are generated at the rail 14 which is installed and supported by the concrete sleeper 13 and thus a track irregularity develops and a problem, in which damage to the track is increased, occurs.

Specifically, a differential settlement of the track is generated by a difference between a degree of compaction of the track bed gravel underneath the concrete sleeper 13 and stiffness of an upper roadbed including the reinforced roadbed, such that problems are generated such as the ride quality degradation, stability degradation of a train service, an increase of a maintenance cost, and so on.

Also, when the train does not run, generation of the differential settlement causes the occurrence of a loose sleeper from which a sleeper hangs on a rail by means of a stiffness of a track panel, and the occurrence of the loose sleeper is very difficult to visually determine so that there is a problem in that proper maintenance may not be performed.

Meanwhile, FIG. 4 is a diagram illustrating maintaining ballast of a sleeper at a track connector by filling a filler according to the related art, and FIG. 5 is a diagram illustrating maintaining ballast of a sleeper at a track connector using oil pressure according to the related art.

As a settlement compensation apparatus according to the related art, a sand bag, a stabilization liquid sprayer, and a method of filling a fusible bag with gravel and the like to install the fusible bag underneath a track have been disclosed. For example, in order to maintain a settled state when ballast is settled, a solid (gravel and the like) filler 32 is filled inside a housing 31 of a predetermined shape installed in ballast underneath a track to stabilize the ballast as shown in FIG. 4 or oil pressure 41 provided through an oil pressure valve 42 is used as shown in FIG. 5.

In an automatic settlement compensation apparatus according to the related art, the settlement compensation apparatus using oil pressure shown in FIG. 5 cannot easily respond to a differential settlement that is generated at left and right sides of a sleeper, and cannot automatically compensate for the differential settlement so that there is a problem in that maintenance is not easy.

Meanwhile, as the related art for addressing the above described problems, an invention filed as a patent application by the present applicant of the present disclosure is disclosed in Korean Patent Publication No. 2013-0137465, entitled of "Automatic Settlement Compensation Apparatus for Rail Tie of Track Connector and Construction Method Thereof," and, when a track settlement is generated at a track connector between a directly fastened track and a ballast track, the invention automatically compensates for a ballast settlement by means of a mechanical engagement of upper and lower parts of a housing and an expansion force of an air bag when the ballast settlement is generated, and also can easily respond to a differential settlement, which is generated at left and right sides of a sleeper, by disposing an automatic sleeper settlement compensation apparatus at each of the left and right sides of the sleeper to compensate for the differential settlement by means of these apparatuses which operate independently. At this point, in such an automatic sleeper settlement compensation apparatus of a track connector, an inner container and an outer container of the apparatus are fastened to the sleeper.

SUMMARY

Technical Problem

To address the above described problems, the technical object of the present disclosure is to provide a sleeper having an embedded automatic track differential settlement compensation apparatus using oil pressure, which is capable of supporting a space generated due to a settlement of track bed gravel or an asphalt roadbed underneath a concrete sleeper by means of a cylindrical rod, automatically compensating for the settlement by installing a single automatic track differential settlement compensation apparatus at each of left and right sides of the concrete sleeper, and easily responding to a differential settlement of left and right rails due to a train load, and a differential settlement compensation method for the same.

Another technical object of the present disclosure is to provide a sleeper having an embedded automatic track differential settlement compensation apparatus using oil pressure, which is capable of reducing pressure in a state in which a track system is maintained to be intact without dismantling a concrete sleeper by installing a pressure reducing valve at an upper part of the concrete sleeper, and improving usability of the concrete sleeper, and a differential settlement compensation method for the same.

Technical Solution

As a means for attaining the above described technical objects, a sleeper having an embedded an automatic track differential settlement compensation apparatus using oil pressure, includes a concrete sleeper installed at track bed gravel or an asphalt roadbed and configured to deliver a traveling load of a train to the track bed gravel or the asphalt roadbed; a first automatic differential settlement compensation apparatus embedded and installed underneath one side of the concrete sleeper and configured to automatically compensate for a differential settlement of the concrete sleeper using oil pressure when a loose sleeper occurs due to the traveling load of the train; and a second automatic differential settlement compensation apparatus embedded and installed underneath the other side of the concrete sleeper so as to operate independently and separately from the first automatic differential settlement compensation apparatus and configured to automatically compensate for the differential settlement of the concrete sleeper using oil pressure when the loose sleeper occurs, wherein the first and second automatic differential settlement compensation apparatuses are separately installed at left and right sides of the concrete sleeper, respectively, thereby automatically compensating for a differential settlement of left and right rails of a track due to the traveling load of the train.

Here, each of the first and second automatic differential settlement compensation apparatuses may expand using the oil pressure to support a space, which is generated by a settlement of the track bed gravel or the asphalt roadbed underneath the concrete sleeper, by means of a cylindrical rod.

Here, each of the first and second automatic differential settlement compensation apparatuses may include a spring having one end fixed to an oil hydraulic cylinder and the other end fixed to the cylindrical rod and configured to provide an expansion force enabling the cylindrical rod to move forward when the loose sleeper occurs; the cylindrical rod configured to move forward by means of the oil pressure so as to come into contact with track bed gravel or an asphalt roadbed which was settled when the loose sleeper occurs due to a differential settlement of the track bed gravel or the asphalt roadbed by the traveling load of the train; an oil tank embedded underneath the concrete sleeper to store oil; the oil hydraulic cylinder configured to receive the oil from the oil tank when vacuum pressure (negative pressure) is generated according to a forward movement of the cylindrical rod; and a check valve installed between the oil tank and the oil hydraulic cylinder so as to open and close an oil supply from the oil tank to the oil hydraulic cylinder.

Here, the check valve may be opened when the vacuum pressure is generated in the oil hydraulic cylinder according to the forward movement of the cylindrical rod, and may be closed when the vacuum pressure in the oil hydraulic cylinder is eliminated by means of the oil being supplied from the oil tank.

Here, oil in the check valve may be moved by the oil pressure from the oil tank in a direction of the oil hydraulic cylinder, and the oil does not flow in a direction of the oil tank opposite the direction of the oil hydraulic cylinder by means of a ball installed inside the check valve, thereby allowing the cylindrical rod to come into fixed contact with the track bed gravel or the asphalt roadbed which was settled.

Here, the sleeper may further include a pressure reducing valve attached to and formed at the oil tank to be exposed above the concrete sleeper, and configured to reduce pressure of oil inside the oil hydraulic cylinder when the cylindrical rod reaches a threshold value, thereby collecting the oil into the oil tank and returning the cylindrical rod to an original position thereof.

Meanwhile, as another means for attaining the above described technical objects, a method for compensating for a differential settlement of a sleeper having first and second embedded automatic differential settlement compensation apparatuses at both ends of the sleeper, respectively, according to the present disclosure, includes a) delivering a traveling load of a train to track bed gravel or an asphalt roadbed through a cylindrical rod of each of the first and second automatic differential settlement compensation apparatuses via a rail and the sleeper; b) expanding and moving a spring inside an oil hydraulic cylinder of the first and second automatic differential settlement compensation apparatuses forward when a loose sleeper occurs; c) moving the cylindrical rod connected to the spring forward to come into contact with track bed gravel or an asphalt roadbed which was settled, and generating vacuum pressure (negative pressure) inside the oil hydraulic cylinder; d) opening a check valve to move oil in an oil tank to an inside of the oil hydraulic cylinder in response to the generation of the vacuum pressure; e) eliminating the vacuum pressure in the oil hydraulic cylinder to close the check valve when the forward movement of the cylindrical rod is terminated; and f) allowing the cylindrical rod, which was fixed, to come into contact with the track bed gravel or the asphalt roadbed, thereby automatically compensating for a differential settlement of the sleeper, wherein each of the first and second automatic differential settlement compensation apparatuses supports a space, which is generated by a settlement of the track bed gravel or the asphalt roadbed underneath the sleeper, by means of the cylindrical rod that expands using the oil pressure.

The method for compensating for a differential settlement of a sleeper having an embedded automatic track differential settlement compensation apparatus according to the present disclosure may further include g) reducing pressure of the oil in the oil hydraulic cylinder through a pressure reducing valve that is attached to and formed at the oil tank when the cylindrical rod reaches a threshold value so as to be exposed above the sleeper, thereby collecting the oil into the oil tank and returning the cylindrical rod to an original position thereof.

Advantageous Effects

In accordance with the present disclosure, it may be possible to support a space generated due to a settlement of track bed gravel or an asphalt roadbed underneath a concrete sleeper by means of a cylindrical rod, to automatically compensate for the settlement by installing a single automatic track differential settlement compensation apparatus at each of left and right sides of the concrete sleeper, and to easily respond to a differential settlement of left and right rails due to a train load.

In accordance with the present disclosure, it may be possible to reduce pressure in a state in which a track system is maintained to be intact without dismantling a concrete sleeper by installing a pressure reducing valve at an upper part of the concrete sleeper, thereby improving usability of the concrete sleeper.

In accordance with the present disclosure, it may be possible to respond to a local settlement of an asphalt roadbed, which may be generated at the asphalt roadbed of a directly fastened track as well as a track bed gravel track.

DESCRIPTION OF EMBODIMENTS

Figure 1:
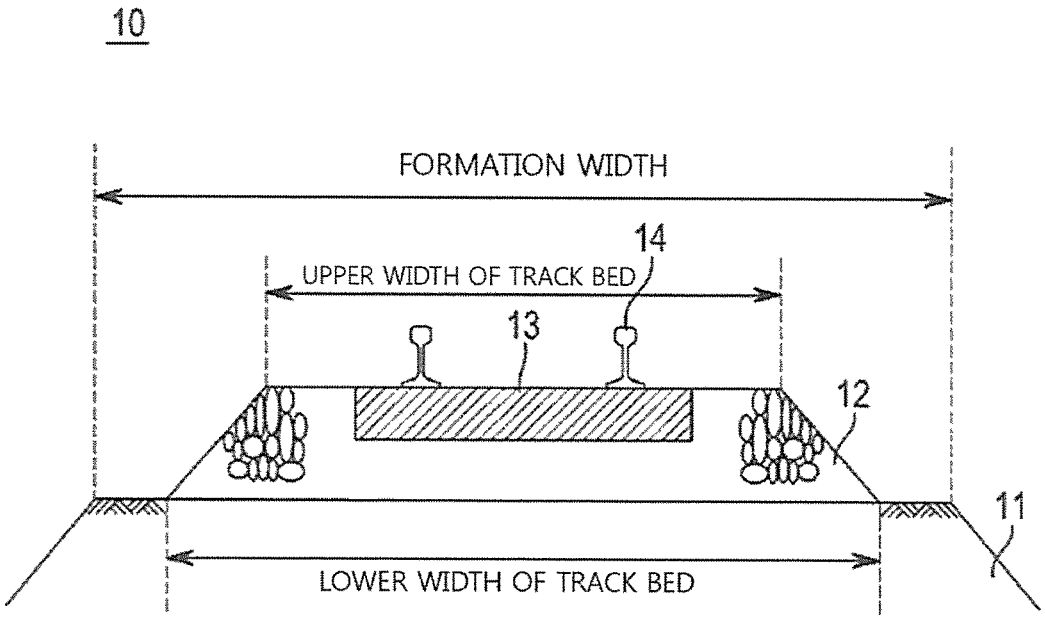
FIG. 1 (RELATED ART)
FIG. 1 is a cross-sectional view of a bed gravel track.
Figure 2:
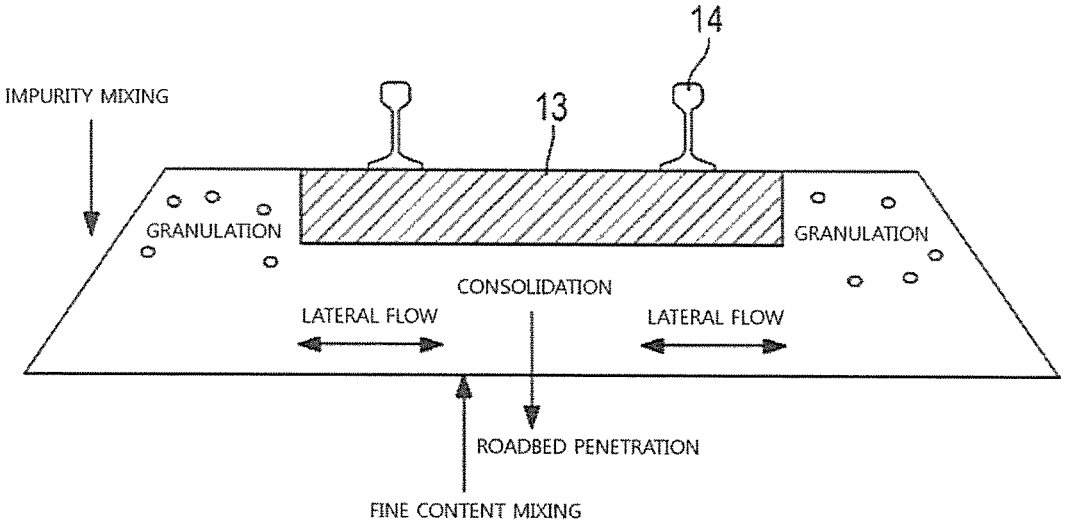
FIG. 2 (RELATED ART)
FIG. 2 is a view for describing a damaged form of track bed gravel of the bed gravel track.
Figure 3A:
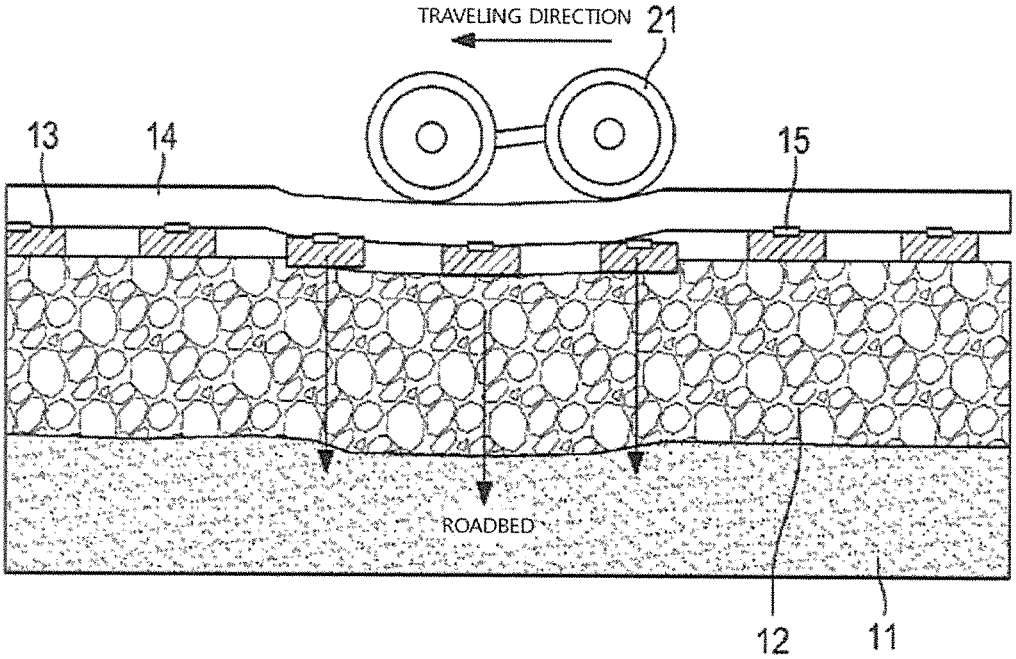
FIG. 3a (RELATED ART)
FIGS. 3*a* and 3*b* are diagrams respectively illustrating a mechanism by which a loose sleeper occurs at a track.
Figure 3B:
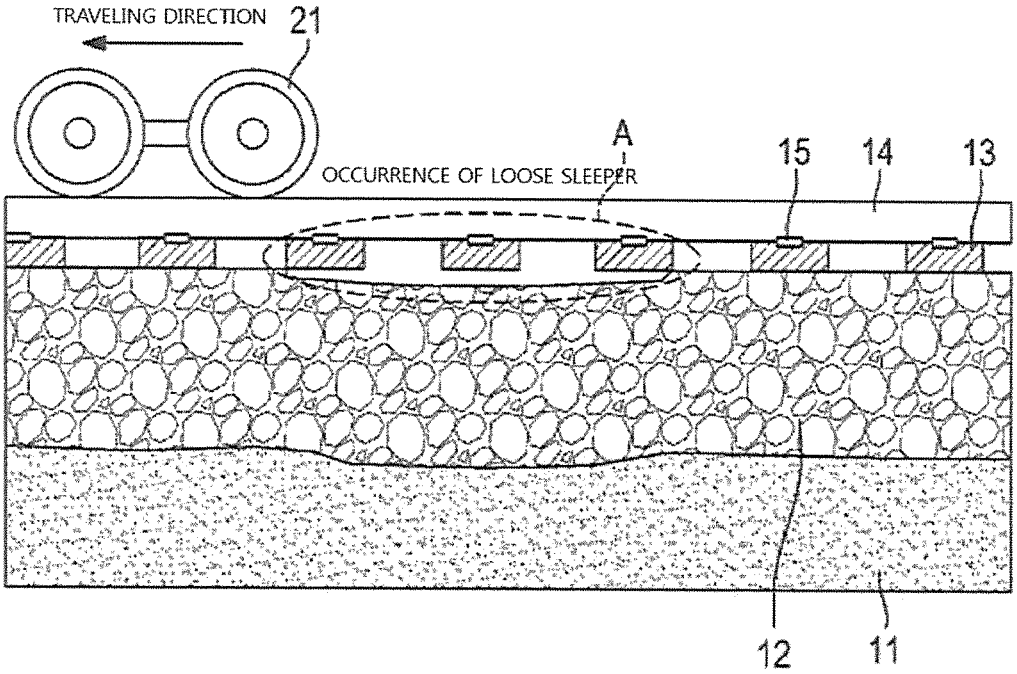
FIG. 3b (RELATED ART)
Figure 4:
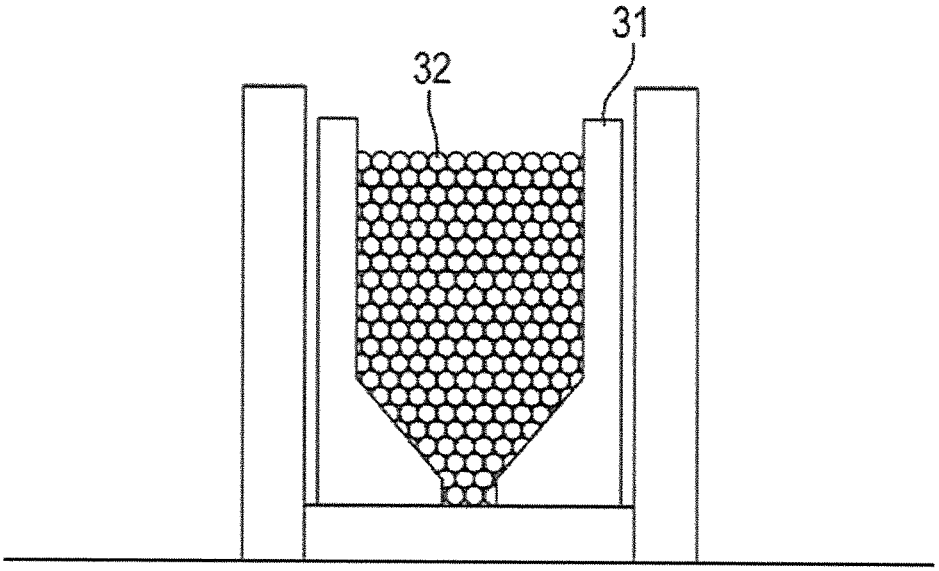
FIG. 4 (RELATED ART)
FIG. 4 is a diagram illustrating maintaining ballast of a sleeper at a track connector by filling a filler according to the related art.
Figure 5:
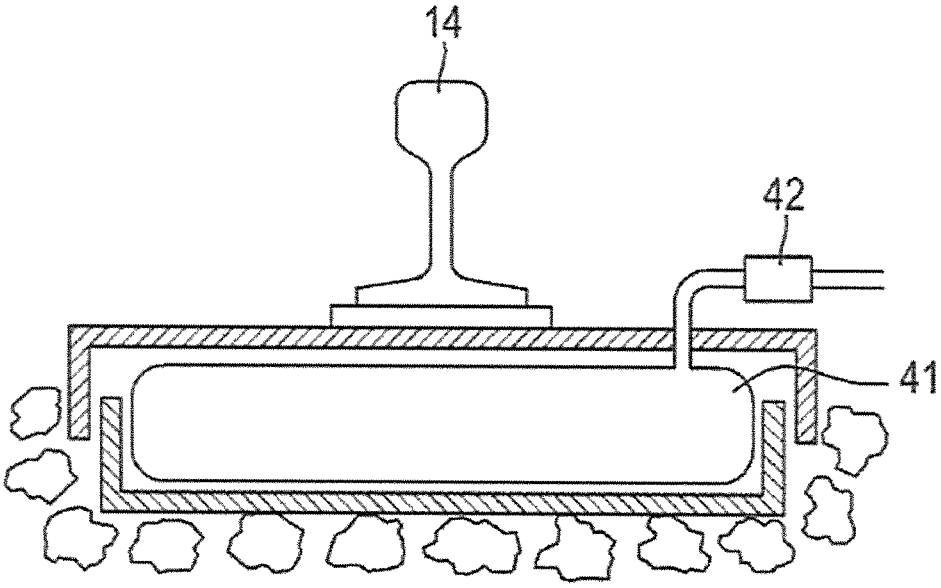
FIG. 5 (RELATED ART)
FIG. 5 is a diagram illustrating maintaining ballast of a sleeper at a track connector using oil pressure according to the related art.

Hereinafter, embodiments of the present disclosure will be fully described in a detail which is suitable for implementation by those skilled in the art with reference to the accompanying drawings. However, the present disclosure may be implemented in various different forms, and thus it is not limited to embodiments to be described herein. Also, in the accompanying drawings, parts not related to the description will be omitted in order to clearly describe the present disclosure, and the same or similar reference numerals are given to components having the same or similar functions throughout the disclosure.

Throughout the disclosure, when a part is described as "comprising" and/or "including" a component, this does not preclude the presence thereof and should be construed as being able to further include other components, unless there is a clearly different meaning in the present application.

[A sleeper 130 having an embedded automatic track differential settlement compensation apparatus 200 using oil pressure]

Figure 6A:
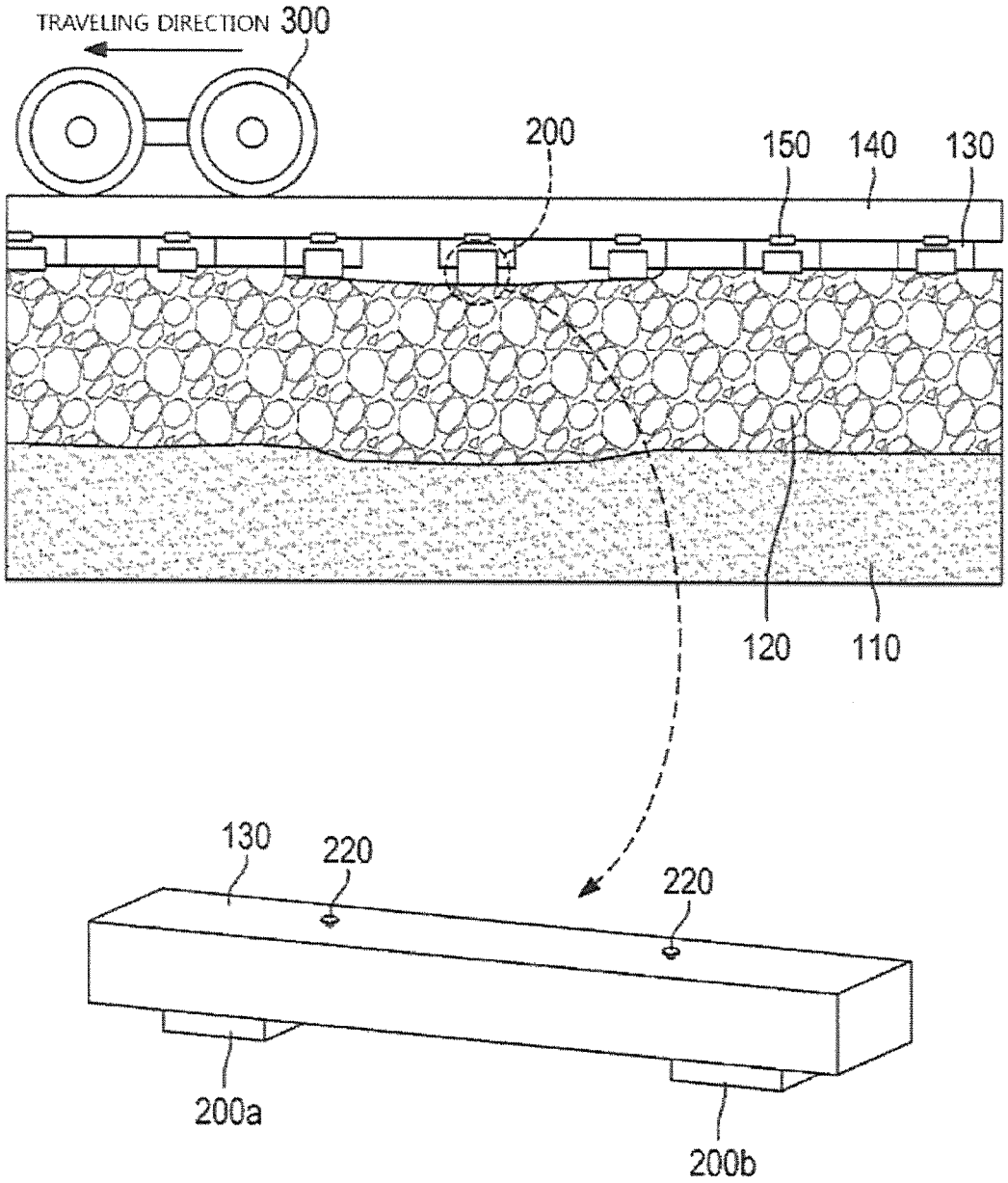
FIGS. 6*a* to 6*c* are diagrams illustrating a sleeper having an embedded automatic track differential settlement compensation apparatus using oil pressure according to an embodiment of the present disclosure installed at track bed gravel or an asphalt roadbed.
Figure 6B:
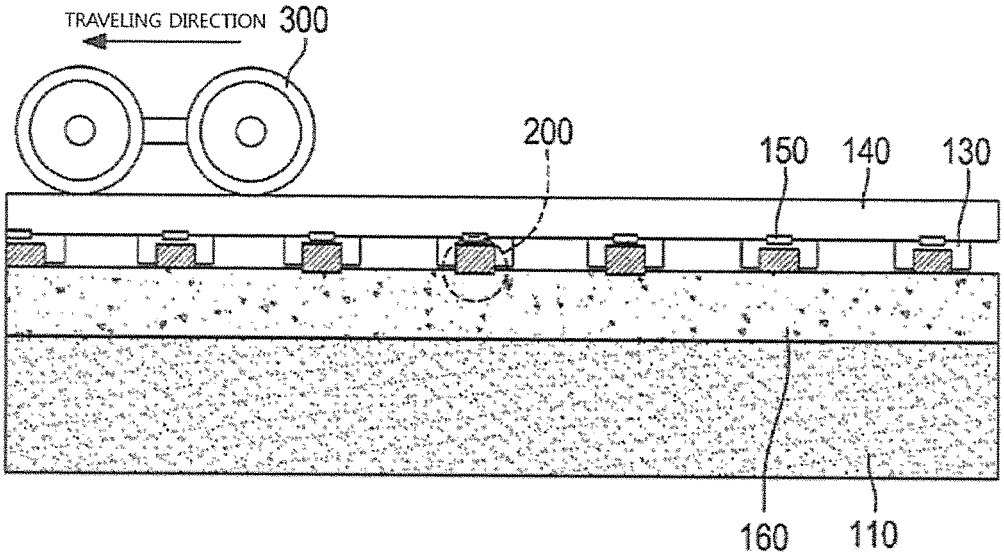
Figure 6C:
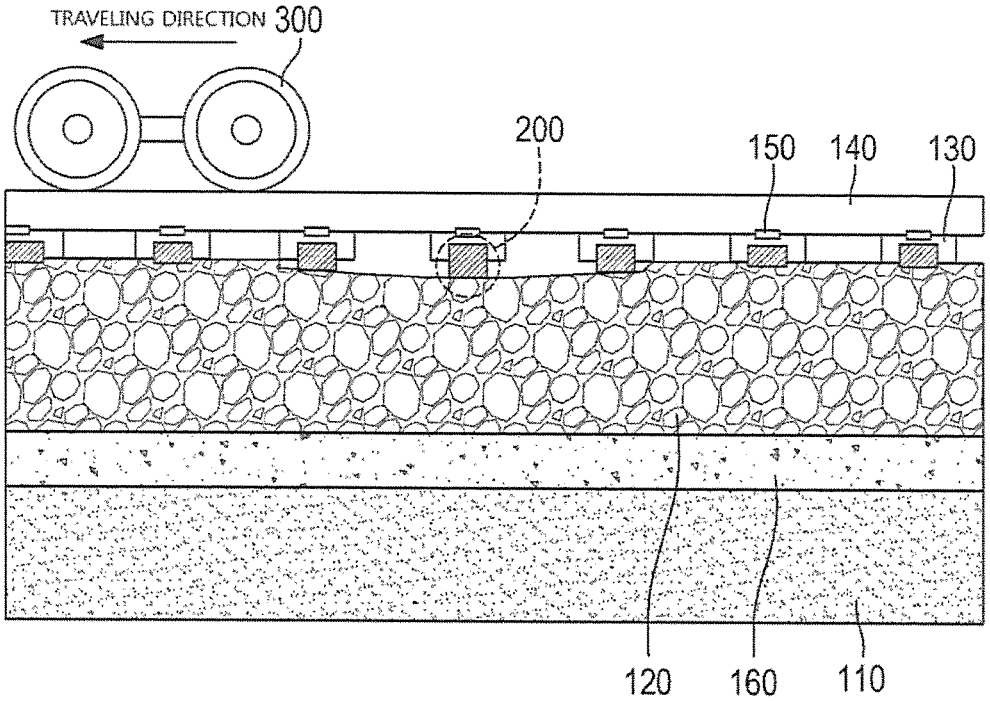

FIGS. 6*a* to 6*c* are diagrams illustrating a sleeper having an embedded automatic track differential settlement compensation apparatus using oil pressure according to an embodiment of the present disclosure installed at track bed gravel or an asphalt roadbed.

As shown in FIG. 6*a*, in terms of a sleeper having an embedded automatic track differential settlement compensation apparatus using oil pressure according to an embodiment of the present disclosure, track bed gravel 120 is formed on a reinforced roadbed 110, a concrete sleeper 130 is installed between the track bed gravel 120 and a rail 140, and the concrete sleeper 130 and the rail 140 are fastened to each other by a rail fastener 150. At this point, automatic track differential settlement compensation apparatuses 200*a* and 200*b* using oil pressure may be embedded and installed underneath both sides of the concrete sleeper 130, and pressure reducing valves 220 may be formed at an upper part of the concrete sleeper 130 to be exposed.

Further, as shown in FIG. 6*b*, in terms of the sleeper having the embedded automatic track differential settlement compensation apparatus using oil pressure according to the embodiment of the present disclosure, an asphalt roadbed 160 is formed on the reinforced roadbed 110, the concrete sleeper 130 is installed between the asphalt roadbed 160 and the rail 140, and the concrete sleeper 130 and the rail 140 are fastened to each other by the rail fastener 150.

In addition, as shown in FIG. 6*c*, in terms of the sleeper having the embedded automatic track differential settlement compensation apparatus using oil pressure according to the embodiment of the present disclosure, the track bed gravel 120 and the asphalt roadbed 160 are formed on the reinforced roadbed 110, and the concrete sleeper 130 is installed between the track bed gravel 120 and the rail 140. At this point, the concrete sleeper 130 and the rail 140 are fastened to each other by the rail fastener 150.

In terms of the sleeper having the embedded automatic track differential settlement compensation apparatus using oil pressure according to the embodiment of the present disclosure, a space, which is generated due to a settlement of the track bed gravel 120 or the asphalt roadbed 160 underneath the concrete sleeper, may be supported by means of a cylindrical rod inside the automatic track differential settlement compensation apparatus 200. At this point, a single automatic track differential settlement compensation apparatus 200 may be installed at each of left and right sides of the concrete sleeper 130, thereby automatically compensating for the settlement and easily responding to a differential settlement of left and right rails of a track due to a train load.

Figure 7:
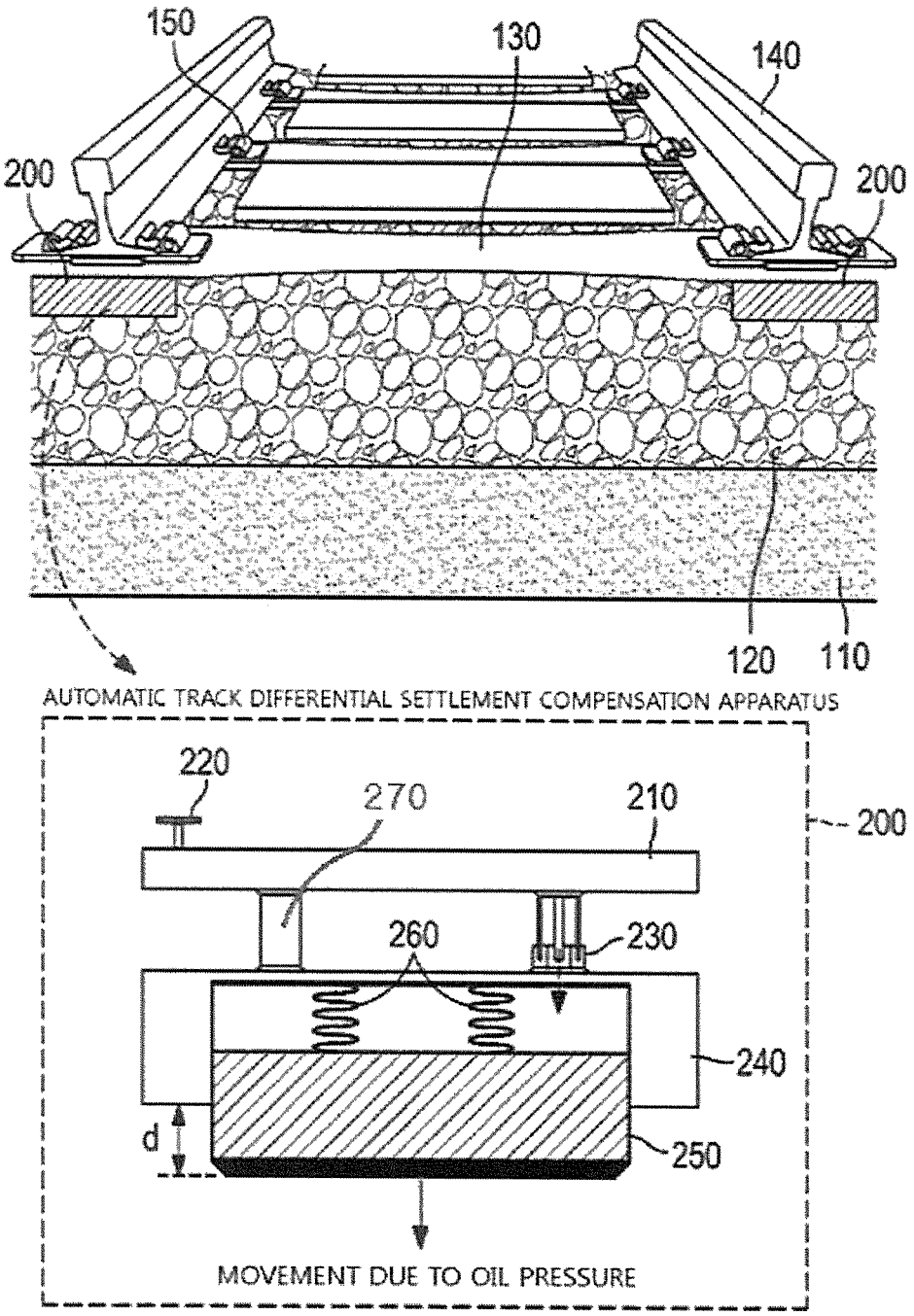
FIG. 7 is a diagram illustrating a sleeper having an embedded automatic track differential settlement compensation apparatus using oil pressure according to an embodiment of the present disclosure.
Figure 8:
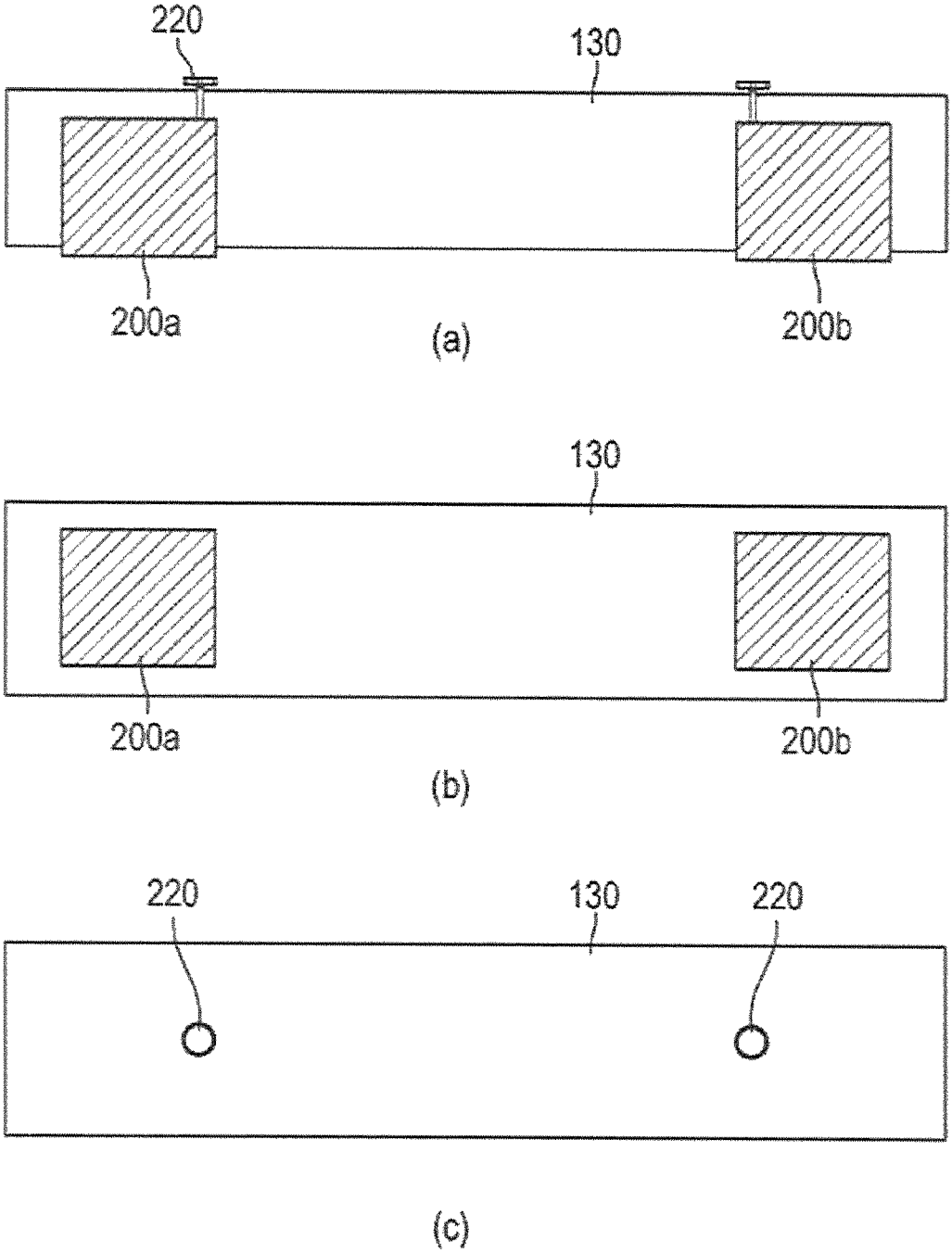
FIG. 8 is a lateral view as shown in (a), a bottom view as shown in (b), and a top view as shown in (c) of a sleeper having an embedded automatic track differential settlement compensation apparatus using oil pressure according to an embodiment of the present disclosure.

Meanwhile, FIG. 7 is a diagram illustrating a sleeper having an embedded automatic track differential settlement compensation apparatus using oil pressureaccording to an embodiment of the present disclosure, and FIG. 8 is a lateral view as shown in (a), a bottom view as shown in (b), and a top view as shown in (c) of a sleeper having an embedded automatic track differential settlement compensation apparatus using oil pressure according to an embodiment of the present disclosure.

With reference to FIGS. 7 and 8, a sleeper having an embedded automatic track differential settlement compensation apparatus using oil pressure according to an embodiment of the present disclosure includes the concrete sleeper 130, the first automatic differential settlement compensation apparatus 200*a*, and the second automatic differential settlement compensation apparatus 200*b*. Here, each of the first and second automatic differential settlement compensation apparatuses 200*a* and 200*b* includes an oil tank 210, the pressure reducing valve 220, a check valve 230, an oil hydraulic cylinder 240, a cylindrical rod 250, a spring 260, and a supporter 270.

The concrete sleeper 130 is installed at the track bed gravel 120 or the asphalt roadbed 160 to deliver a traveling load of a train 300 to the track bed gravel 120 or the asphalt roadbed 160.

The first automatic differential settlement compensation apparatus 200*a* is embedded and installed underneath one side of the concrete sleeper 130 to automatically compensate for a differential settlement of the concrete sleeper 130 using oil pressure when a loose sleeper occurs due to the traveling load of the train 300.

The second automatic differential settlement compensation apparatus 200*b* is embedded and installed underneath the other side of the concrete sleeper 130 so as to separately operate from the first automatic differential settlement compensation apparatus 200*a*, and it automatically compensates for a differential settlement of the concrete sleeper 130 using oil pressure when a loose sleeper occurs.

For example, as shown in (a) to (c) of FIG. 8, each of the first and second automatic differential settlement compensation apparatuses 200*a* and 200*b* expand using oil pressure to support a space, which is generated due to a settlement of the track bed gravel 120 or the asphalt roadbed 160 underneath the concrete sleeper 130, by means of the cylindrical rod 250. As such, the first and second automatic differential settlement compensation apparatuses 200*a* and 200*b* are separately installed at left and right sides of the concrete sleeper 130, respectively, thereby automatically compensating for a differential settlement of left and right rails 140 of a track by the traveling load of the train 300.

In particular, the oil tank 210, which is formed at each of the first and second automatic differential settlement compensation apparatuses 200*a* and 200*b*, is embedded underneath the concrete sleeper 130 to store oil.

The pressure reducing valve 220 is attached to and formed at the oil tank 210 so as to be exposed above the concrete sleeper 130, and reduces pressure of the oil inside the oil hydraulic cylinder 240 when the cylindrical rod 250 reaches a threshold value, thereby collecting the oil into the oil tank 210 and returning the cylindrical rod 250 to the original position thereof.

The check valve 230 is installed between the oil tank 210 and the oil hydraulic cylinder 240 to open and close an oil supply from the oil tank 210 to the oil hydraulic cylinder 240. At this point, the check valve 30 is opened when vacuum pressure is generated inside the oil hydraulic cylinder 240 according to a forward movement of the cylindrical rod 250, and it is closed when the vacuum pressure inside the oil hydraulic cylinder 240 is eliminated by means of the oil being supplied from the oil tank 210. For example, the oil is moved from the oil tank 210 in a direction of the oil hydraulic cylinder 240 in the check valve 230 by means of oil pressure, and the oil does not flow in a direction of the oil tank 210 opposite the direction of the oil hydraulic cylinder 240 by means of a ball 231 installed inside the check valve 230 so that the cylindrical rod 250 comes into fixed contact with the track bed gravel 120 or the asphalt roadbed 160 which settled.

The oil hydraulic cylinder 240 receives the oil supplied from the oil tank 210 when vacuum pressure (negative pressure) is generated according to the forward movement of the cylindrical rod 250.

When a loose sleeper occurs due to a differential settlement of the track bed gravel 120 or the asphalt roadbed 160 by the traveling load of the train 300, the cylindrical rod 250 is moved forward by means of oil pressure to come into contact with the track bed gravel 120 or the asphalt roadbed 160 which settled. For example, when the track bed gravel 120 or the asphalt roadbed 160 settles by an amount of d, the cylindrical rod 250 is automatically advanced to come into contact with the track bed gravel 120 or the asphalt roadbed 160 and then is fixed thereto in response to such a settlement amount.

One side of the spring 260 is fixed to the oil hydraulic cylinder 240 and the other side thereof is fixed to the cylindrical rod 250 so that the spring 260 provides an expansion force capable of moving the cylindrical rod 250 forward when a loose sleeper occurs. At this point, one or more springs 260 may be installed.

The supporter 270 is installed between the oil tank 210 and the oil hydraulic cylinder 240 and serves to support the oil tank 210 on the oil hydraulic cylinder 240.

Figure 9:
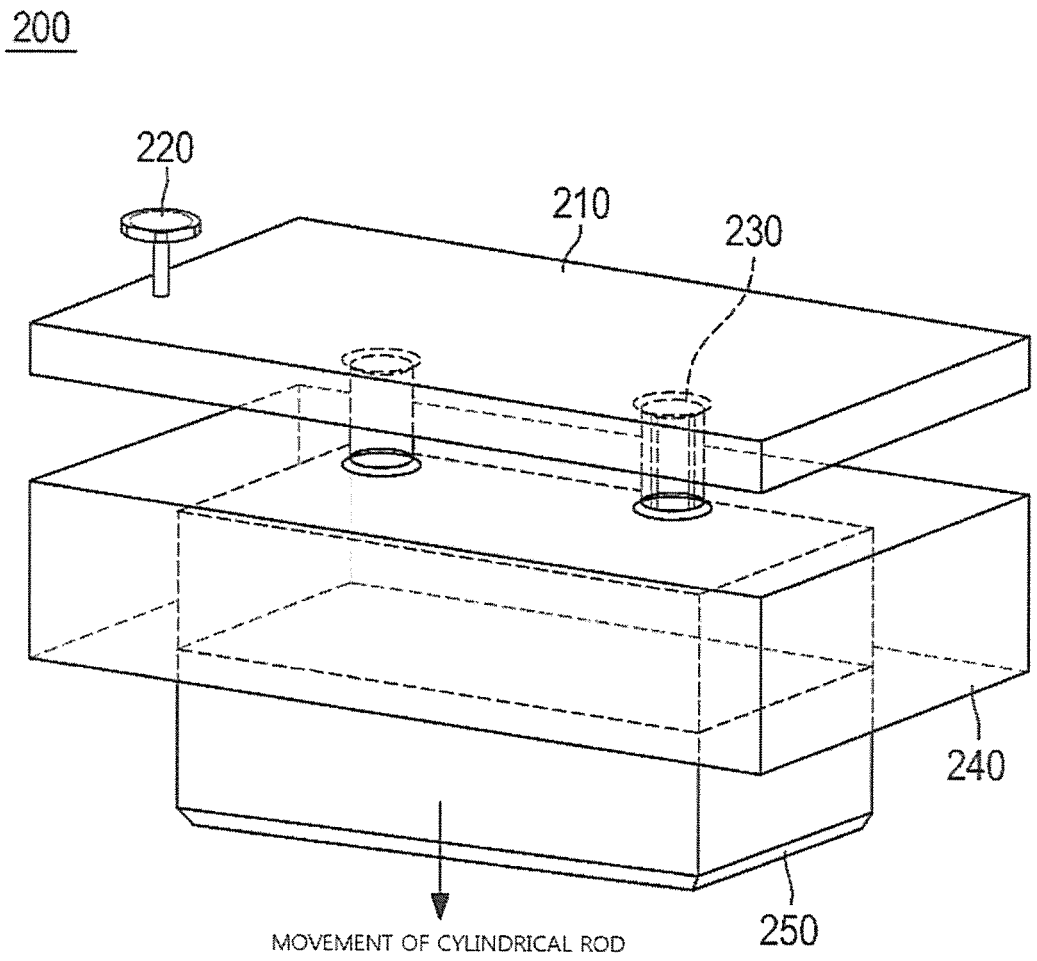
FIG. 9 is a diagram for schematically describing an automatic differential settlement compensation apparatus in a sleeper having an embedded automatic track differential settlement compensation apparatus using oil pressure according to an embodiment of the present disclosure.
Figure 10:
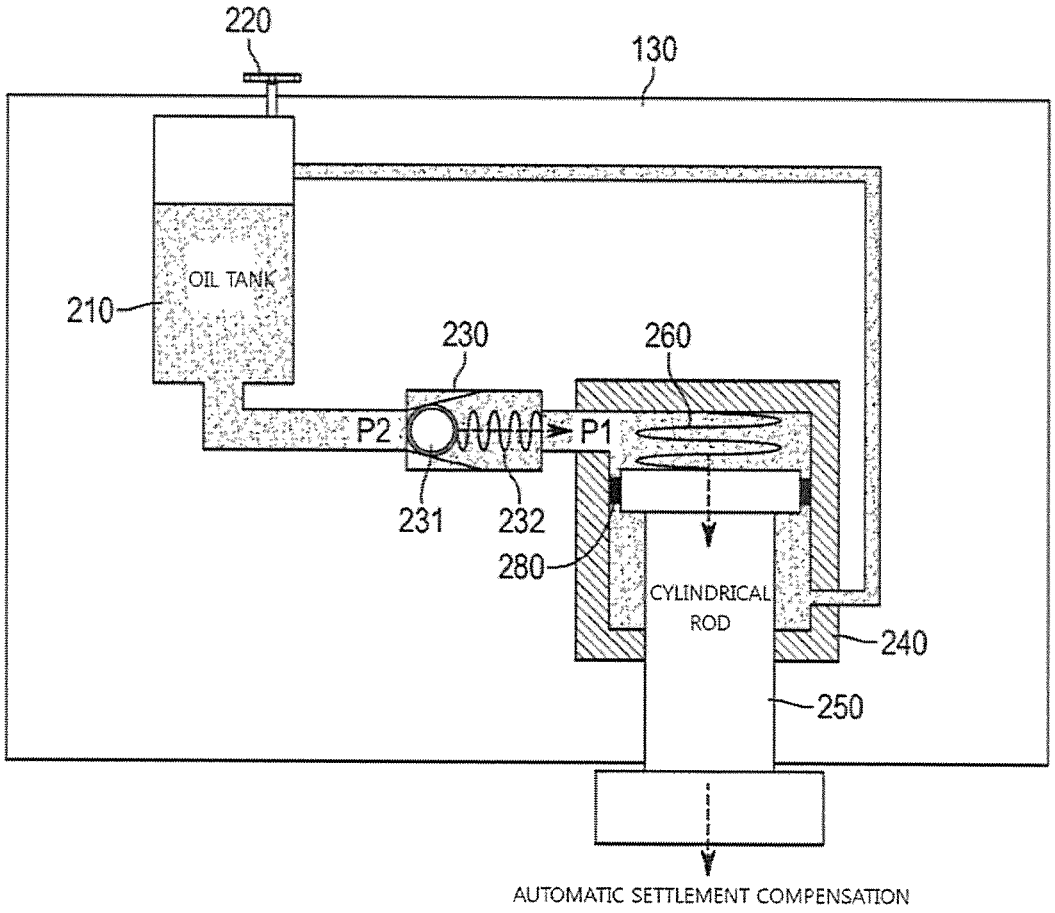
FIG. 10 is a diagram for describing a principle of a check valve of the automatic differential settlement compensation apparatus shown in FIG. 9 in detail.

Meanwhile, FIG. 9 is a diagram for schematically describing an automatic differential settlement compensation apparatus in a sleeper having an embedded automatic track differential settlement compensation apparatus using oil pressure according to an embodiment of the present disclosure, and FIG. 10 is a diagram for describing a principle of a check valve of the automatic differential settlement compensation apparatus shown in FIG. 9 in detail.

A sleeper having an embedded automatic track differential settlement compensation apparatus using oil pressure according to an embodiment of the present disclosure has a structure in which the automatic differential settlement compensation apparatus 200 using oil pressure is installed in the concrete sleeper 130. As shown in FIG. 10, the automatic differential settlement compensation apparatus 200 may be configured with the oil tank 210, the pressure reducing valve 220, the check valve 230, the oil hydraulic cylinder 240, the cylindrical rod 250, the spring 260, and a packing 280. A single automatic differential settlement compensation apparatus 200 shown in FIG. 9 may be installed at each of left and right sides of the concrete sleeper 130, thereby easily responding to a differential settlement of left and right rails of a track due to a traveling load of the train 300.

In particular, with reference to FIG. 10, when a loose sleeper occurs due to a differential settlement of the track bed gravel 120 or the asphalt roadbed 160 by a train load, the cylindrical rod 250 is moved forward by means of the spring 260 to come into contact with the track bed gravel 120 or the asphalt roadbed 160 which settled, and negative pressure (vacuum pressure) is generated inside the oil hydraulic cylinder 240.

Oil of the oil tank 210 is moved to the oil hydraulic cylinder 240 according to a principle of the check valve 230 when such vacuum pressure is generated, and the vacuum pressure inside the oil hydraulic cylinder 240 is eliminated when the forward movement of the cylindrical rod 250 is completed. At this point, the check valve 230 is closed. For example, assuming that pressure inside a space between the spring 260 in the oil hydraulic cylinder 240 and the cylindrical rod 250 is P1, when a loose sleeper occurs due to a differential settlement between the track bed gravel 120 or the asphalt roadbed 160 by a train load and thus the cylindrical rod 250 is moved forward by means of the spring 260, vacuum pressure is generated inside the space between the spring 260 and the cylindrical rod 250, and the check valve 230 is opened. As a result, the oil in the oil tank 210 is supplied inside the oil hydraulic cylinder 240 by means of an oil pressure P2, and the check valve 230 is closed when the vacuum pressure is eliminated.

Specifically, the check valve 230 is operated according to a principle that the oil is moved from the oil tank 210 in a stretching direction of the cylinder rod 250 by means of the oil pressure but does not flow in a direction of the oil tank 210 opposite the stretching direction of the cylinder rod 250 by means of the ball 231 inside the check valve 230 so that the cylindrical rod 250 is fixed. At this point, the ball 231 inside the check valve 230 is returned to the original position by a spring 232.

Also, the traveling load of the train 300 is delivered to the track bed gravel 120 or the asphalt roadbed 160 through the cylindrical rod 250 of the automatic differential settlement compensation apparatus 200 via the rail 140 and the sleeper 130.

When the cylindrical rod 250 of the automatic differential settlement compensation apparatus 200 reaches a threshold value due to an increase of a settlement of the track bed gravel 120 or the asphalt roadbed 160, the pressure reducing valve 220 attached to the oil tank 210 is opened to collect the oil, which is inside the oil hydraulic cylinder 240, into the oil tank 210 and, at the same time, the cylindrical rod 250 is returned to an original position thereof so that the collected oil may be reused.

In addition, because the pressure reducing valve 220 is installed at the upper part of the concrete sleeper 130, pressure reducing may be performed in a state in which a track system is maintained to be intact without dismantling the installed concrete sleeper 130, and thus it may be possible to improve usability of the sleeper having the embedded automatic track differential settlement compensation apparatus using oil pressure according to the embodiment of the present disclosure. In other words, when the pressure reducing valve 220 is opened to perform pressure reducing, the oil in the space between the cylindrical rod 250 and the oil hydraulic cylinder 240 is collected along a pipe and the cylindrical rod 250 is returned to an original position thereof.

Figure 11A:
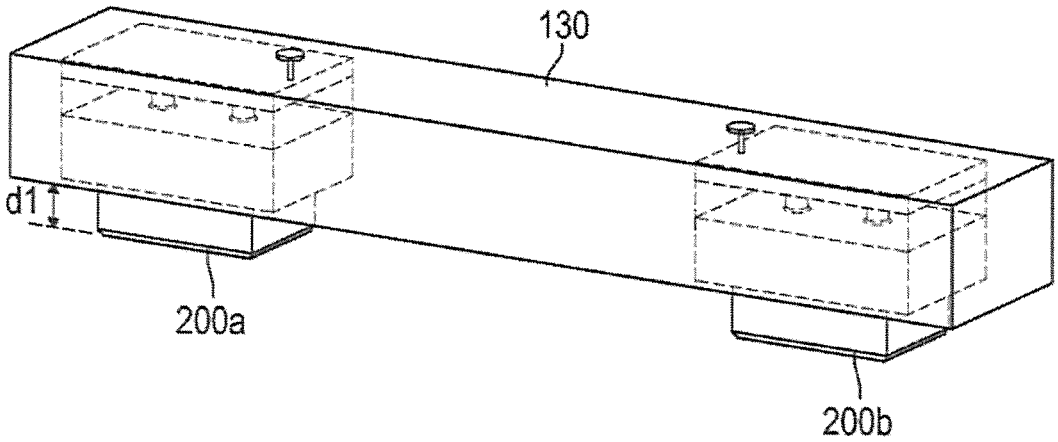
FIGS. 11*a* and 11*b* are diagrams for describing an automatic compensation for a differential settlement at a sleeper having an embedded automatic track differential settlement compensation apparatus using oil pressure according to an embodiment of the present disclosure.
Figure 11B:
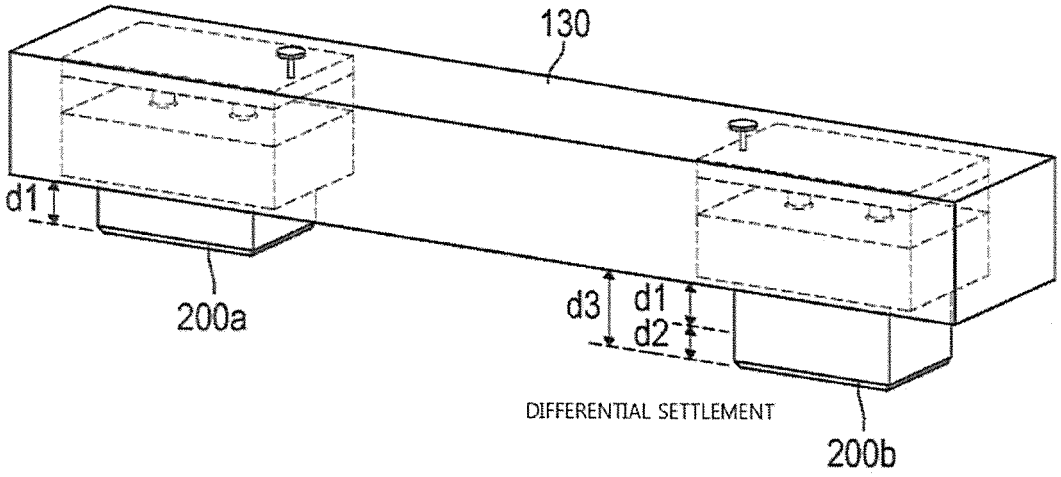

Meanwhile, FIGS. 11*a* and 11*b* are diagrams for describing an automatic compensation for a differential settlement at a sleeper having an embedded automatic track differential settlement compensation apparatus using oil pressure according to an embodiment of the present disclosure.

As shown in FIG. 11, in the sleeper 130 having the embedded automatic track differential settlement compensation apparatus using oil pressure according to the embodiment of the present disclosure, the first and second automatic differential settlement compensation apparatuses 200*a* and 200*b* protrude by an amount of d1 to be substantially the same as each other when a settlement of the track bed gravel 120 or the asphalt roadbed 160 does not occur, whereas the second automatic differential settlement compensation apparatus 200*b* moves forward from d1 by an amount of d2 to protrude up to d3, for example, when a loose sleeper floating by the amount of d2 occurs only at a right rail due to a differential settlement of the track bed gravel 120 or the asphalt roadbed 160 by a train load. That is, in the sleeper 130 having the embedded automatic track differential settlement compensation apparatus using oil pressure according to the embodiment of the present disclosure, the first and second automatic differential settlement compensation apparatuses 200*a* and 200*b* may operate separately and independently, thereby easily responding to the differential settlement.

Therefore, the sleeper having the embedded automatic track differential settlement compensation apparatus using oil pressure according to the embodiment of the present disclosure has a structure capable of supporting a space generated due to a settlement of the track bed gravel underneath the concrete sleeper 130 by means of the cylindrical rod 250 by installing the automatic compensation apparatus using oil pressure instead of a concrete sleeper that is conventionally used so that the automatic compensation apparatus may easily respond to a local settlement of the asphalt roadbed, which can be generated at the asphalt roadbed of a directly fastened track as well as an existing gravel track.

[Method for Compensating for the Sleeper 130 having the Embedded Automatic Track Differential Settlement Compensation Apparatus 200]

Figure 12:
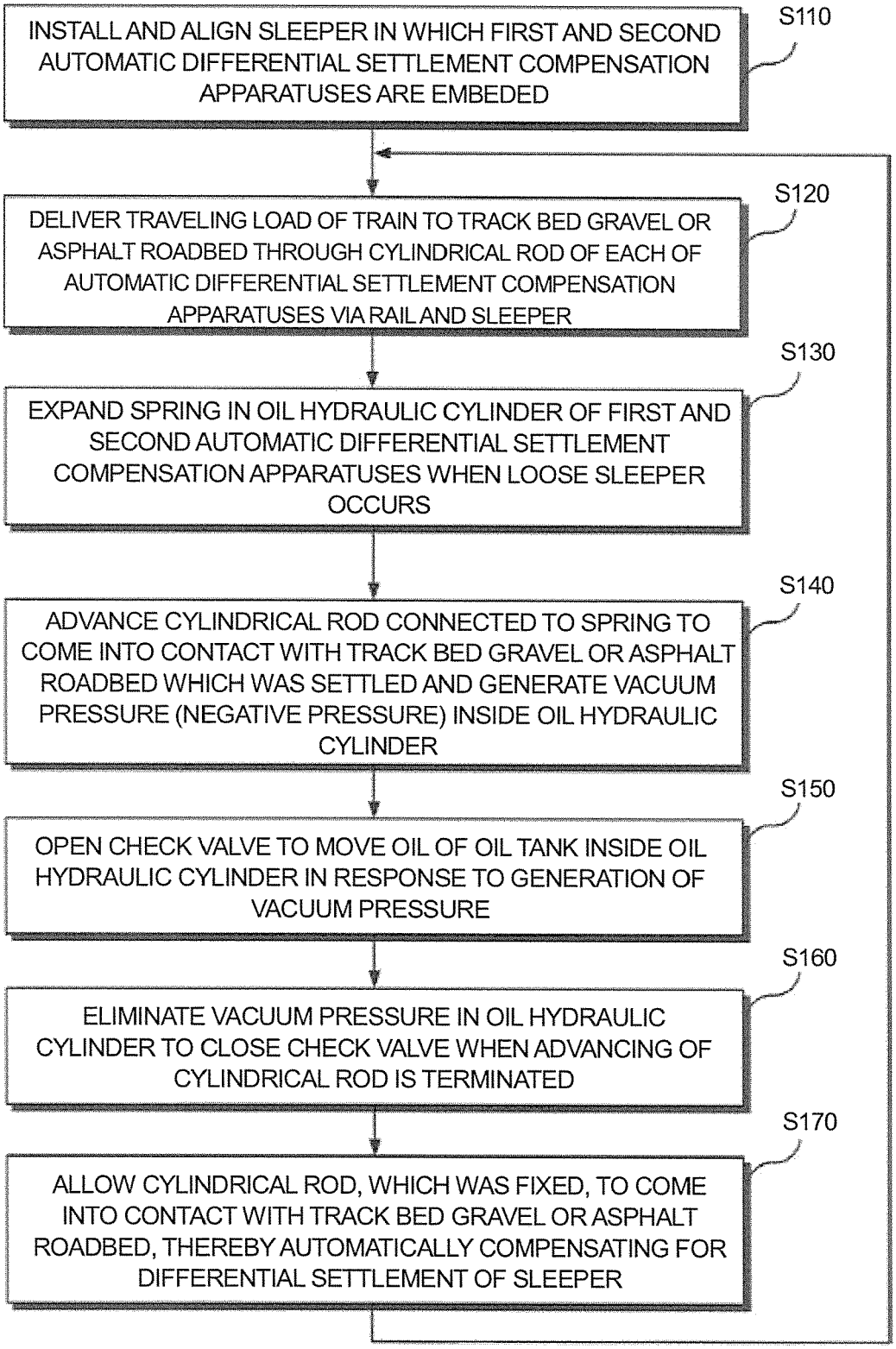
FIG. 12 is a flow chart of a differential settlement compensation method for a sleeper having an embedded automatic track differential settlement compensation apparatus using oil pressure according to an embodiment of the present disclosure.

FIG. 12 is a flow chart of a differential settlement compensation method for a sleeper having an embedded automatic track differential settlement compensation apparatus using oil pressure according to an embodiment of the present disclosure.

With reference to FIG. 12, the differential settlement compensation method for a sleeper having an embedded automatic track differential settlement compensation apparatus using oil pressure according to the embodiment of the present disclosure is a differential settlement compensation method for the sleeper 130 having the first and second embedded automatic differential settlement compensation apparatuses 200*a* and 200*b* at both ends of the sleeper 130, respectively, and firstly, the sleeper 130 having the first and second embedded automatic differential settlement compensation apparatuses 200*a* and 200*b* is installed and aligned at the track bed gravel 120 or the asphalt roadbed 160 (S110).

Then, a traveling load of the train 300 is delivered to the track bed gravel 120 or the asphalt roadbed 160 through the cylindrical rod 150 of each of the first and second automatic differential settlement compensation apparatuses 200*a* and 200*b* via the rail 140 and the sleeper 130 (S120).

Thereafter, when a loose sleeper occurs, the spring 260 inside the oil hydraulic cylinder 240 of each of the first and second automatic differential settlement compensation apparatuses 200*a* and 200*b* expands to move forward (S130).

Next, the cylindrical rod 250 connected to the spring 260 moves forward to come into contact with the track bed gravel 120 or the asphalt roadbed 160 which settled, and vacuum pressure (negative pressure) is generated inside the oil hydraulic cylinder 240 (S140).

And, the check valve 230 is opened in response to the generation of the vacuum pressure and thus oil inside the oil tank 210 flows into the oil hydraulic cylinder 240 (S150), and then the vacuum pressure inside the oil hydraulic cylinder 240 is eliminated and the check valve 230 is closed when the forward movement of the cylindrical rod 250 is terminated (S160). That is, the check valve 230 is opened when the vacuum pressure is generated inside the oil hydraulic cylinder 240, and it is closed when the vacuum pressure inside the oil hydraulic cylinder 240 is eliminated by the oil being supplied from the oil tank 210. Also, in the check valve 230, the oil flows by oil pressure from the oil tank 210 in a direction of the oil hydraulic cylinder 240, but it does not flow in the opposite direction, that is, in a direction of the oil tank 210, by the ball 231 installed in the check valve 230 so that the cylindrical rod 250 comes into contact with the track bed gravel 120 or the asphalt roadbed 160 which settled, thereby being fixed thereto.

Thereafter, the fixed cylindrical rod 150 comes into contact with the track bed gravel 120 or the asphalt roadbed 160, thereby automatically compensating for a differential settlement of the sleeper 130 (S170).

In the differential settlement compensation method for a sleeper having an embedded automatic track differential settlement compensation apparatus using oil pressure according to the embodiment of the present disclosure, each of the first and second automatic differential settlement compensation apparatuses 200*a* and 200*b* supports a space generated due to a settlement of the track bed gravel 120 or the asphalt roadbed 160 underneath the concrete sleeper 130 by means of the cylindrical rod 250 that expands using oil pressure.

Subsequently, when the cylindrical rod 250 reaches a threshold value, the pressure of the oil inside the oil hydraulic cylinder 240 is reduced through the pressure reducing valve 220, which is attached to and formed at the oil tank 210 so as to be exposed above the concrete sleeper 130, so that the oil may be collected into the oil tank 210 and the cylindrical rod 250 may be returned to the original position thereof. At this point, the pressure reducing valve 220 is exposed to the outside above the upper part of the concrete sleeper 130 so that the pressure reducing may be performed in a state in which a track system is maintained to be intact without dismantling the concrete sleeper 130, and as a result, usability of the concrete sleeper may be improved.

According to the embodiments of the present disclosure, the cylindrical rod supports a space generated due to a settlement of the track bed gravel or the asphalt roadbed underneath the concrete sleeper, and a single cylindrical rod is separately installed at each of left and right sides of the concrete sleeper, thereby automatically compensating for the settlement and easily responding to a differential settlement of left and right rails of a track due to a train load. Also, the pressure reducing valve is installed at the upper part of the concrete sleeper so that the pressure reducing may be performed in a state in which a track system is maintained to be intact without dismantling the concrete sleeper, and as a result, usability of the concrete sleeper may be improved. In addition, a local settlement of the asphalt roadbed, which may occur at the asphalt roadbed of a directly fastened track as well as a track bed gravel track, may be responded to.

The description of the present disclosure has been illustratively provided and it should be understood that numerous other modifications and embodiments can be easily devised by those skilled in the art without changing the technical spirit or essential features of the present disclosure. Therefore, the embodiments disclosed herein should be construed as a number of illustrative embodiments of the present disclosure while not being limited thereto. For example, each component described in a single form may be performed in a distributed manner, and similarly, components described to be distributed may be performed in a combined form.

The scope of the present disclosure will be represented by the appended claims rather than the above detailed description, and all alterations or other modified embodiments derived from the meaning, range, and equivalents of the appended claims should be construed as being included in the scope of the present disclosure.

The invention claimed is:

1. A sleeper having an embedded automatic track differential settlement compensation apparatus using oil pressure, comprising:

a concrete sleeper (130), installed at a track bed gravel (120) or an asphalt roadbed (160) and configured to deliver a traveling load of a train (300) to the track bed gravel (120) or the asphalt roadbed (160);

a first automatic differential settlement compensation apparatus (200*a*), embedded and installed underneath one side of the concrete sleeper (130) and configured to automatically compensate for a differential settlement of the concrete sleeper (130) using oil pressure when a loose sleeper occurs due to the traveling load of the train (300); and a second automatic differential settlement compensation apparatus (200*b*), embedded and installed underneath the other side of the concrete sleeper (130) so as to operate independently and separately from the first automatic differential settlement compensation apparatus (200*a*) and configured to automatically compensate for the differential settlement of the concrete sleeper (130) using oil pressure when the loose sleeper occurs, wherein the first and second automatic differential settlement compensation apparatuses (200*a*, 200*b*) are separately installed at left and right sides of the concrete sleeper (130), respectively, thereby automatically compensating for a differential settlement of left and right rails (140) due to the traveling load of the train (300), wherein each of the first and second automatic differential settlement compensation apparatuses includes:

a spring (260), having one end fixed to an oil hydraulic cylinder (240) and the other end fixed to a cylindrical rod (250) and configured to provide an expansion force enabling the cylindrical rod (250) to move forward when the loose sleeper occurs;

the cylindrical rod (250), configured to move forward by means of the oil pressure so as to come into contact with the track bed gravel (120) or the asphalt roadbed (160) which was settled when the loose sleeper occurs due to a differential settlement of the track bed gravel (120) or the asphalt roadbed (160) by the traveling load of the train (300);

an oil tank (210), embedded underneath the concrete sleeper (130) to store oil;

the oil hydraulic cylinder (240), configured to receive the oil from the oil tank (210) when a vacuum pressure, which is a negative pressure, is generated according to a forward movement of the cylindrical rod (250); and a check valve (230), installed between the oil tank (210) and the oil hydraulic cylinder (240) so as to open and close an oil supply from the oil tank (210) to the oil hydraulic cylinder (240).

2. The sleeper according to claim 1, wherein each of the first and second automatic differential settlement compensation apparatuses (200*a*, 200*b*) expands using the oil pressure to support a space, which is generated by a settlement of the track bed gravel (120) or the asphalt roadbed (160) underneath the concrete sleeper (130), by means of a cylindrical rod (250).

3. The sleeper according to claim 1, wherein the check valve (230) is opened when the vacuum pressure is generated in the oil hydraulic cylinder (240) according to the forward movement of the cylindrical rod (250), and is closed when the vacuum pressure in the oil hydraulic cylinder (240) is eliminated by means of the oil being supplied from the oil tank (210).

4. The sleeper according to claim 3, wherein the oil in the check valve (230) is moved by the oil pressure from the oil tank (210) in a direction of the oil hydraulic cylinder (240), and the oil does not flow in a direction of the oil tank (210) opposite the direction of the oil hydraulic cylinder (240) by means of a ball (231) installed inside the check valve (230), thereby allowing the cylindrical rod (250) to come into fixed contact with the track bed gravel (120) or the asphalt roadbed (160) which was settled.

5. The sleeper according to claim 1, further comprising:

a pressure reducing valve (220), attached to and formed at the oil tank (210) to be exposed above the concrete sleeper (130) and configured to reduce pressure of the oil inside the oil hydraulic cylinder (240) when the cylindrical rod (250) reaches a threshold value, thereby collecting the oil into the oil tank (210) and returning the cylindrical rod (250) to an original position thereof.

6. A method for compensating for a differential settlement of a sleeper (130) having first and second embedded automatic differential settlement compensation apparatuses (200*a*, 200*b*) at both ends of the sleeper (130), respectively, comprising:

a) delivering a traveling load of a train (300) to a track bed gravel (120) or an asphalt roadbed (160) through a cylindrical rod (250) of each of the first and second automatic differential settlement compensation apparatuses (200*a*, 200*b*) via a rail (140) and the sleeper (130), wherein the sleeper (130) is made of a material including a concrete;

b) expanding and moving a spring (260) in an oil hydraulic cylinder (240) of the first and second automatic differential settlement compensation apparatuses (200*a*, 200*b*) forward when a loose sleeper occurs;

c) moving the cylindrical rod (250) connected to the spring (260) forward to come into contact with the track bed gravel (120) or the asphalt roadbed (160)

which was settled, and generating a vacuum pressure, which is a negative pressure, inside the oil hydraulic cylinder (240);

d) opening a check valve (230) to move oil in an oil tank (210) to an inside of the oil hydraulic cylinder (240) in response to generation of the vacuum pressure;

e) eliminating the vacuum pressure inside the oil hydraulic cylinder (240) to close the check valve (230) when a forward movement of the cylindrical rod (250) is terminated; and f) allowing the cylindrical rod (250), which was fixed, to come into contact with the track bed gravel (120) or the asphalt roadbed (160), thereby automatically compensating for a differential settlement of the sleeper (130), wherein each of the first and second automatic differential settlement compensation apparatuses (200*a*, 200*b*) supports a space, which is generated by a settlement of the track bed gravel (120) or the asphalt roadbed (160) underneath the sleeper (130), by means of the cylindrical rod (250) that expands using the oil pressure.

7. The method according to claim 6, further comprising:

g) reducing pressure of the oil inside the oil hydraulic cylinder (240) through a pressure reducing valve (220) that is attached to and formed at the oil tank (210) when the cylindrical rod (250) reaches a threshold value so as to be exposed above the sleeper (130), thereby collecting the oil into the oil tank (210) and returning the cylindrical rod (250) to an original position thereof.

8. The method according to claim 6, wherein the check valve (230) of d) is opened when the vacuum pressure is generated, and is closed when the vacuum pressure inside the oil hydraulic cylinder (240) is eliminated by means of the oil being supplied from the oil tank (210).

9. The method according to claim 8, wherein the oil in the check valve (230) is moved by the oil pressure from the oil tank (210) in a direction of the oil hydraulic cylinder (240), and the oil does not flow in a direction of the oil tank (210) opposite the direction of the oil hydraulic cylinder (240) by means of a ball (231) installed inside the check valve (230), thereby allowing the cylindrical rod (250) to come into fixed contact with the track bed gravel (120) or the asphalt roadbed (160) which was settled.

* * * * *